US005874876A

United States Patent [19]

Kobayashi et al.

[11] Patent Number: 5,874,876

[45] Date of Patent: Feb. 23, 1999

[54] ELECTROMAGNETIC RELAY STRUCTURE

[75] Inventors: Shigeru Kobayashi; Nobuo Ishibashi, both of Tokyo, Japan

[73] Assignee: Niles Parts Co., Ltd., Japan

[21] Appl. No.: 772,924

[22] Filed: Dec. 24, 1996

[30] Foreign Application Priority Data

Dec. 28, 1995 [JP] Japan ..... 7-353040

[51] Int. Cl.[6] ..... H01H 67/02

[52] U.S. Cl. ..... 335/128; 335/202

[58] Field of Search ..... 335/78–86, 124, 335/128, 202, 192

[56] References Cited

U.S. PATENT DOCUMENTS 4,975,739 12/1990 Noda ..... 335/128

5,291,166 3/1994 Chikira ..... 335/78

FOREIGN PATENT DOCUMENTS 2-27639 2/1990 Japan .

*Primary Examiner*—Lincoln Donovan

*Attorney, Agent, or Firm*—Ronald P. Kananen; Rader, Fishman & Grauer

[57] ABSTRACT

An electromagnetic relay structure which includes a bobbin 1 having a coil 5 wound therearound. A coil terminal 6 is electrically connected with an end 5*a* of the coil 5. A base 4 is insert-formed with a terminal 8, 9. The coil terminal 6 has a first end firmly attached to a flange 1*c* of the bobbin 1 and a second end connected to the terminal 8, 9. A projecting piece 6*a* is formed in a generally central portion of the coil terminal 6. The projecting piece 6*a* is bent with an end 5*a* of the coil 5 twined therearound, to thereby support the end 5*a* of the coil 5. Another flange 1*a* of the bobbin 1 is fixed to the base 4 by fitting a projecting rod 1*b* of the flange 1*a* to a fitting groove 4*a* of the base 4.

12 Claims, 4 Drawing Sheets

ELECTROMAGNETIC RELAY STRUCTURE

BACKGROUND OF THE INVENTION

1. Field of the Invention

The present invention relates to structures for electromagnetic relays. More specifically, the present invention relates to a structure of an electromagnetic relay which has a coil terminal firmly attached at one end to an end portion of the bobbin with the other end connected to a terminal, wherein a projecting piece is provided in a generally central portion of the coil terminal so that the projecting piece is bent with an end of the coil twined therearound.

2. Description of the Prior Art

A conventional electromagnetic relay structure is disclosed, for example, in Japanese Unexamined Utility Model Publication No. H2-27639. The electromagnetic relay structure described in this publication has coil terminals around which respective ends of the coil are twined. The coil terminals are firmly attached by press-fitting to a terminal.

In the conventional electromagnetic relay, however, the coil terminal has a portion, around which the end of the coil is twined, which is vertically standing and facing the bobbin. Thus, there has been a problem in that difficulty is encountered in twining an end of the coil around the coil terminal, and the coil once twined is apt to be untied and fall away from the coil terminal.

SUMMARY OF THE INVENTION

It is an object of the present invention to provide an electromagnetic relay structure that solves the problems of the conventional structure described above.

More specifically, it is an object of the present invention to provide an electromagnetic relay structure having a coil securely fixed to a coil terminal by attaching one end of the coil terminal to a flange of the bobbin with the other end being connected to a terminal, wherein the coil terminal has a projecting piece formed in a central portion thereof to twine with an end of the coil and then be bent.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In order to achieve the above objects, an electromagnetic relay structure according to the present invention comprises a bobbin having a coil wound therearound, a coil terminal electrically connected with an end of the coil wound around the bobbin, a base insert-formed with a terminal, a flange to which a first end of the coil terminal is firmly attached with a second end of the coil terminal being connected to the terminal, and a projecting piece formed in a generally central portion of the coil terminal, the projecting piece being bent with an end of the coil twined therearound.

Also, the coil terminal can be made to have an upper end press-fitted into an insertion hole in the flange of the bobbin, and a lower end formed with a forked portion press-fitted to an upper end of the terminal.

Further, the bobbin can be made to have flanges formed on opposite sides thereof so that one of the flanges has a projecting rod formed in a lower portion thereof for being fitted to a first fitting groove of the base, and the other one of the flanges has the coil terminal inserted therein.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

Figure 1:
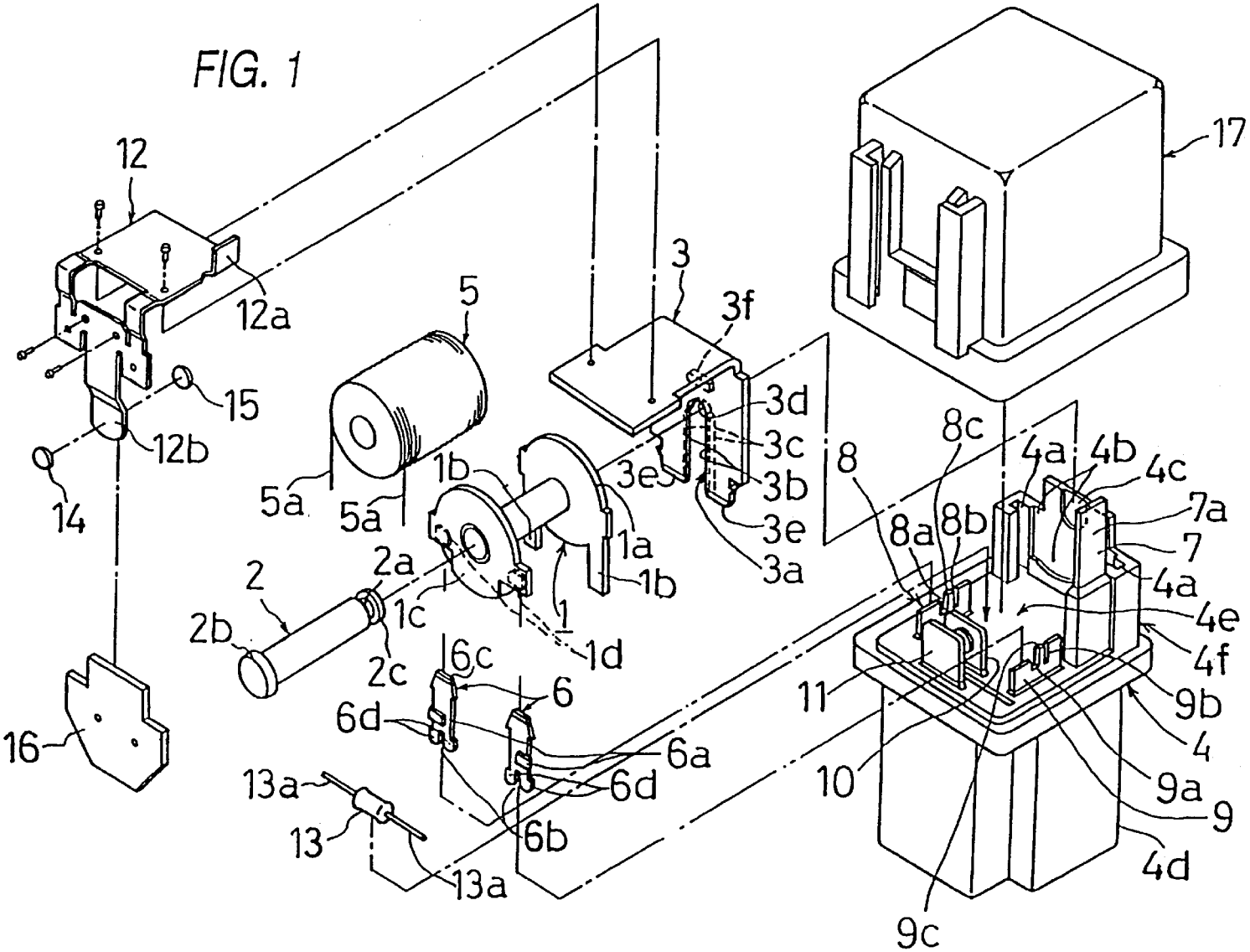
FIG. 1 is an exploded perspective view of an electromagnetic relay structure according a preferred embodiment of the present invention.
Figure 2:
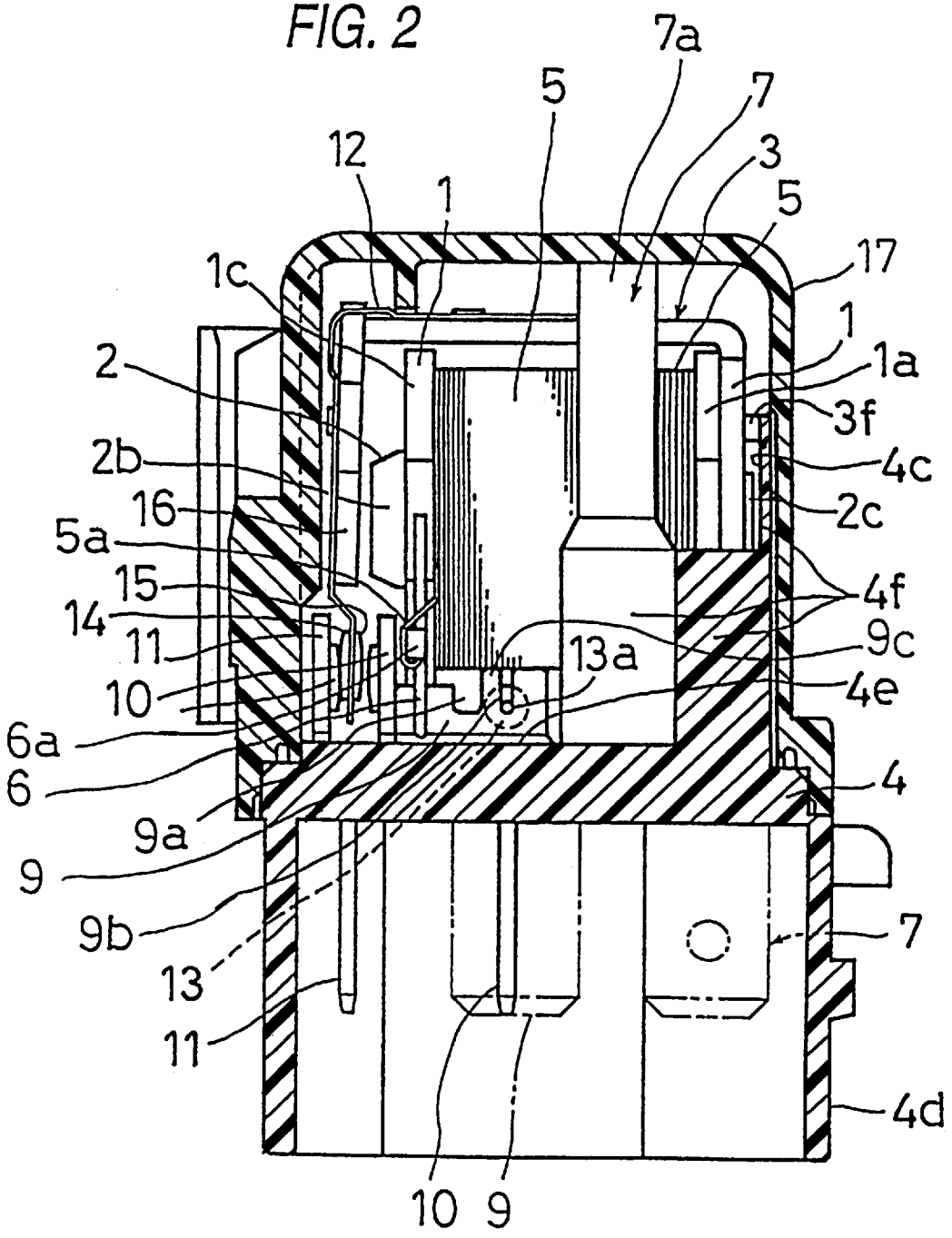
FIG. 2 is a magnified front sectional view of the electromagnetic relay structure according to the present invention.

A preferred embodiment of the present invention will now be described with reference to FIGS. 1 to 4 of the accompanying drawings.

An electromagnetic relay structure according to the present invention includes a bobbin 1 that has a coil 5 wound therearound and an iron core 2 inserted therethrough. The bobbin 1 has one flanged portion 1*a*, on a side which is fixed to a yoke 3, formed with projecting rods 1*b* at lower opposite ends thereof. The bobbin 1 also has another flanged portion 1*c*, on a side toward an armature 16, formed with insertion holes 1*d* at lower opposite ends thereof into which respective upper ends 6*c* of coil terminals 6 are press-fitted. The bobbin 1 is fixed on a base 4 by press-fitting the projecting rods 1*b* into respective first fitting grooves 4*a* and press-fitting the fitted coil terminals 6 onto respective upper ends of terminals 8 and 9. Further, the bobbin 1 is supported on the iron core 2 by fixing the iron core 2 in a cutout groove 3*a* of the yoke 3.

The iron core 2, which is inserted into a center of the bobbin 1, has one end formed with a small diameter portion 2*a* and the other end formed with a head portion 2*b*. The iron core 2 at its small diameter portion 2*a* is press-fitted into the cutout groove 3*a* provided in the yoke 3 so that the iron core 2, together with the bobbin 1, is secured to the yoke 3. The iron core 2 has a dished portion 2*c* provided by the formation of the small diameter portion 2*a*. The dished portion 2*c* is fitted into a generally U-shaped cutout groove 4*c* by attaching the bobbin 1 to the base 4.

Figure 3:
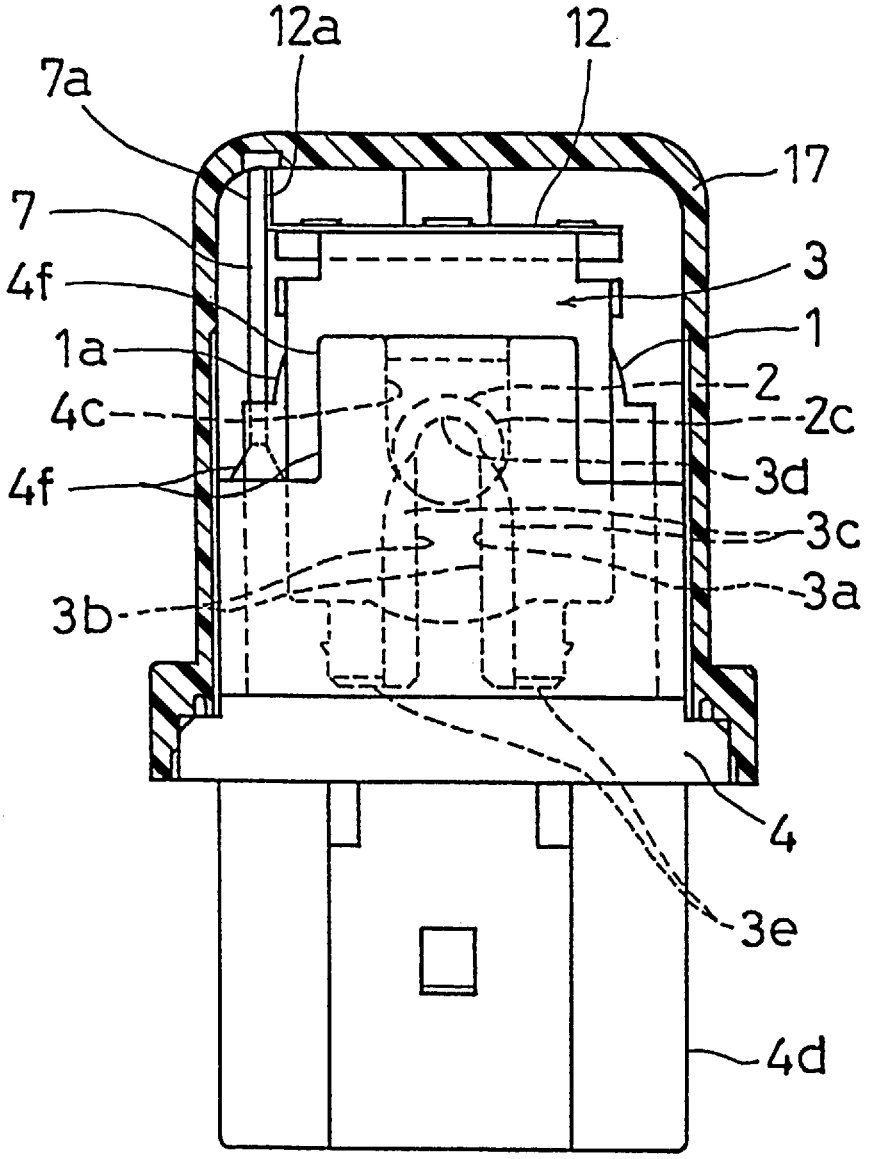
FIG. 3 is a magnified side sectional view of the electromagnetic relay structure according to the present invention.
Figure 4:
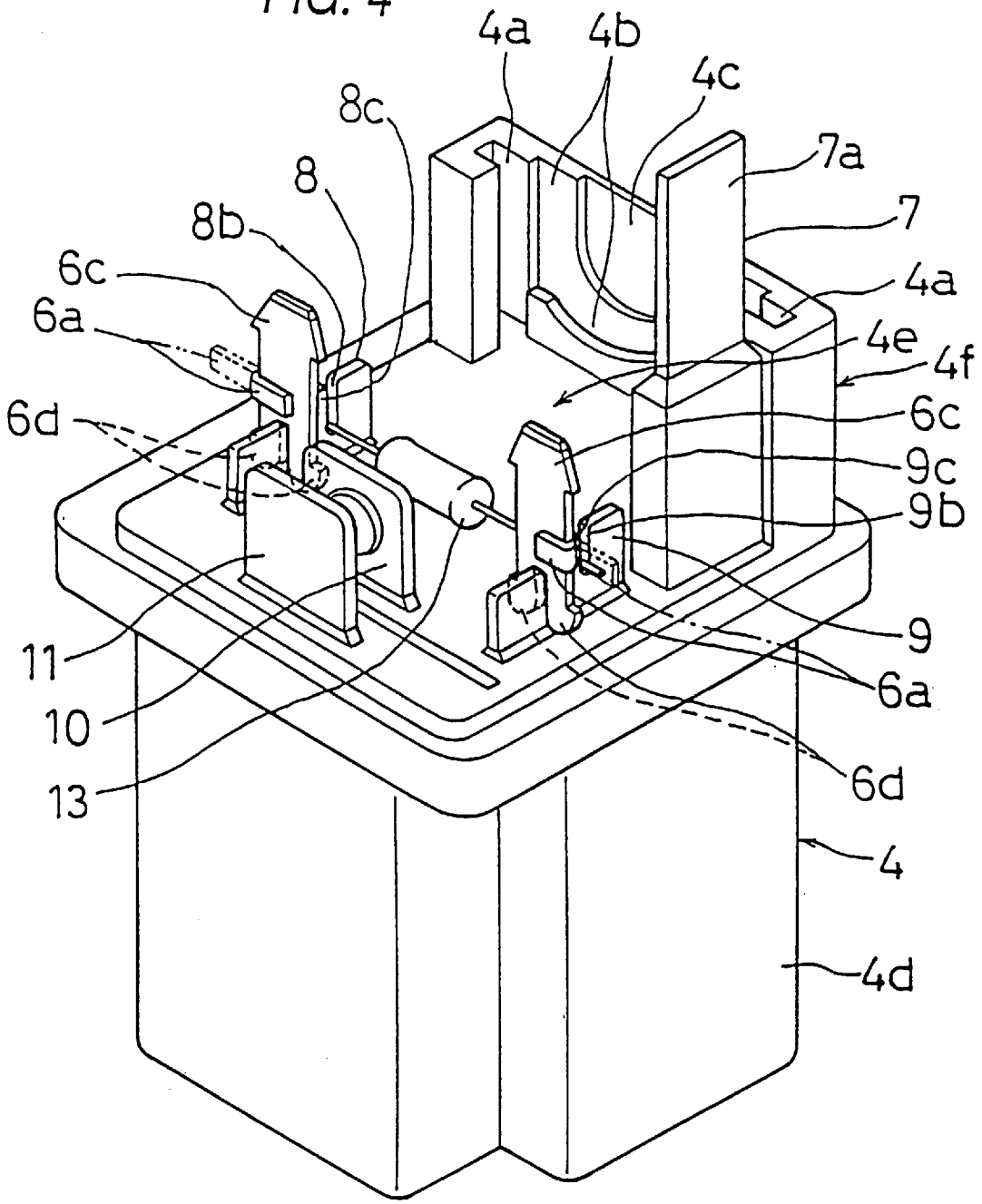
FIG. 4 is a magnified perspective view of a base of the electromagnetic relay structure in a state wherein coil terminals and an electronic element are attached to terminals of the base.

The yoke 3 is formed by a conductive plate member into a generally L-shaped form, so that it has one end formed with a tongue piece 3*e* and the other end having a leaf spring 12 attached thereto by fastening screws. The leaf spring 12 is formed by a conductive sheet member. The cutout groove 3*a*, as shown in FIGS. 1 and 3, is formed into a U-shape to have slant surfaces 3*c* in opposite sides 3*b* thereof. The cutout groove 3*a* has a deep end 3*d* formed in a semicircular shape in the U-shaped cutout groove 3*a*. The slant surfaces 3*c* are formed in an arcuate form on the side of the deep end 3*d*, as shown in FIG. 3.

The yoke 3 has two tongue pieces 3*e* which are provided by the formation of the cutout groove 3*a*. The yoke 3 has a seal projection 3*f* formed in an outer lateral surface above the U-shaped cutout groove 4*c*, which projection 3*f* is fitted in an upper opening end of the U-shaped cutout groove 4*c*. The tongue pieces 3*e* have an outer lower portion formed in a saw-tooth form so that the tongue piece 3*e* is press-fitted into a second fitting groove 4*b* of the base 4. When the tongue pieces 3*e* of the yoke 3 are press-fitted into the second fitting groove 4*b*, the seal projection 3*f* is received in the U-shaped cutout groove 4*c*.

The base 4 is insert-formed with terminals 7, 8, 9, 10, 11. The base 4 is integrally formed with a rib 4*f* for preventing curving and vibration of a vibration preventive portion 7*a* projecting from a panel face 4*e*. The rib 4*f* is a wall projection formed in a generally squared U-shape projecting from the panel face 4*e*, and has the first fitting groove 4*a*, the second fitting groove 4*b*, and the U-shaped cutout groove 4*c* in an inner wall face thereof.

The coil 5, which is wound around the bobbin 1, has respective ends 5*a* twined around the projecting pieces 6*a* on the coil terminals 6 for providing electrical connection.

The coil terminals 6 each have an upper end 6*c* firmly received in a respective insertion hole 1*d*, a lower end press-fitted on an upper end of a respective terminal 8, 9, and an intermediate portion having a projecting piece 6*a* projecting therefrom. The coil terminals 6 are each formed of a planar conductive member. The projecting piece 6*a* is twined around by the end 5*a* of the coil 5 and thereafter bent approximately 180° back over the planar face of the coil terminal 6. A forked portion 6*b* is defined in each of the coil terminals 6 by a groove formed between semicircular projections 6*d* for being press-fitted onto an upper end of the terminals 8, 9. The forked portion 6*b* of each coil terminal 6 has a width which is the same as or somewhat narrower than the thickness of the respective terminals 8, 9 so that the terminals 8, 9 can receive the forked portions 6*b*. The upper end 6*c* is generally in a wedge form for being fixed by press-fitting in the insertion hole 1*d*.

The terminals 7, 8, 9, 10, 11 project at their upper ends from the panel face 4*e* with their lower ends projected toward the inside of a connector 4*d*. The terminal 7 is integrally formed with the vibration preventive portion 7*a* projecting from the base 4.

The vibration preventive portion 7*a* serves dual purposes as an electrically conductive passage for electrical connection between the leaf spring 12, which is firmly fixed at one end to the yoke 3, and the terminal 7, which is firmly fixed to the base 4, and as a member for sustaining the yoke 3. The terminal 7 is spot-welded to a connecting piece 12*a* of the leaf spring 12, which is firmly attached at its upper end to the yoke 3.

The terminals 8, 9 each have a split groove 8*a*, 9*a* for receiving a lower end of the terminals 6, a split groove 8*b*, 9*b* into which a lead wire 13*a*, 13*a* is press-fitted, and a tongue piece 8*c*, 9*c* provided by the formation of the split groove 8*a*, 9*a* and the split groove 8*b*, 9*b*. The terminals 8, 9 are offset by 90 degrees with respect to the coil terminals 6.

The terminals 10, 11 project from the panel face 4*e* and are juxtaposed in an opposed manner to each other. Movable contacts 14, 15 are interposed between the terminal 10 and the terminal 11 and are firmly attached to an actuating piece 12*b* of the leaf spring 12. The leaf spring 12, which is formed by a conductive sheet member, is fixed by screw fastening on the yoke 3, and is also screw-fastened with the armature 16.

The electronic element 13 is a resistor or the like having lead wires 13*a*, 13*a* extending to the right and the left. The movable contacts 14, 15 are respectively formed by drum-shaped contact members, which are deposited on or fastened to the leaf spring 12. The armature 16 is formed by a ferrous sheet member screw-fastened to the leaf spring 12. A case 17 is fitted on the base 4 to provide an airtight seal through ultrasonic welding or the like.

The preferred embodiment of the electromagnetic relay structure according to the present invention has been described above. A procedure for assembling the relay structure will now be described.

First, the terminals 7, 8, 9, 10, and 11 are insert-formed to the base 4. The terminal 7 has an integrally formed vibration preventive portion 7*a*, thereby reducing the number of parts and assembling process steps. The opposite lead wires 13*a*, 13*a* of the electronic element 13 are press-fitted into the respective split grooves 8*b*, 9*b* of the terminals 8, 9, which are then held by bending the tongue pieces 8*c*, 9*c* toward the electronic element 13. The coil 5 is wound around the bobbin 1. The coil terminals 6 are press-fitted at their upper ends 6*c* into the respective insertion holes 1*d* so that the coil terminals 6 are firmly attached on the bobbin 1.

The ends 5*a* of the coil 5 are twined around the respective projecting pieces 6*a*, and then the projecting pieces 6*a* are bent approximately 180° back over the planar face of the terminals 6. This allows the ends 5*a* of the coil 5 to be sustained by the bent projecting pieces 6*a*, thereby preventing untying and falling of the ends from the coil terminals 6. Also, connecting points are provided to the ends 5*a* of the coil 5, which can be easily fixed without soldering.

The projecting rods 1*b* are press-fitted into the first fitting grooves 4*a* of the base 4, and the projections 6*d*, 6*d* of the coil terminals 6 are press-fitted onto the upper ends of the terminals 8, 9, thereby firmly fixing the bobbin 1 on the base 4 at opposite sides. Thus, the bobbin 1 can be firmly fixed to the base 4 in a manner free from being jolted, by press-fitting the projecting rods 1*b* of the flange 1*a* into the first fitting grooves 4*a*, and by press-fitting the coil terminals 6 into the terminals 8, 9 with the flange 1*c* already firmly fixed on the coil terminals 6. Also, two sets of the coil terminals 6 attached to the bobbin 1 will completely prevent the bobbin 1 from being jolted sideways by engaging and press-fitting the forked portions 6*b* to the two sets of terminals 8, 9.

The leaf spring 12 is deposited with the movable contacts 14, 15, and is screw-fastened with the yoke 3 and the armature 16. The iron core 2 is inserted into a through-hole of the bobbin 1. The tongue pieces 3*e* of the yoke 3 are respectively press-fitted into the second fitting grooves 4*b*, while the small diameter portion 2*a* is press-fitted into the deep end 3*d* of the cutout groove 3*a*. The press-fitting of the iron core 2 to the yoke 3 fixes the bobbin 1 firmly to the base 4.

The connecting piece 12*a* is spot-welded to the vibration preventive portion 7*a*. The leaf spring 12 is fixed on the yoke 3 using screws with the connecting piece 12*a* thereof spot-welded to the vibration preventive portion 7*a* so that electrical connection is provided between the terminal 7 and the movable contacts 14, 15 and firm fixing is provided for the leaf spring 12 and the yoke 3.

The vibration preventive portion 7*a* of the terminal 7 is supported by the rib 4*f* projecting from the panel face 4*e*, which provides excellent impact resistance and vibration resistance.

The present invention, structured as above-explained, provides the following effects.

According to the present invention, the electromagnetic relay structure comprises a bobbin having a coil wound therearound, a coil terminal electrically connected with an end of the coil, a base insert-formed with a terminal, a flange to which one end of the coil terminal is firmly attached with the other end of the coil terminal connected to the terminal, and a projecting piece formed generally in a central portion of the coil terminal, the projecting piece being bent approximately 180° with an end of the coil twined therearound. It is therefore possible to firmly fix the coil to the coil terminal to thereby prevent the coil from being disconnected from the coil terminal due to impact, and so forth.

In the above structure, the coil terminal can be made to have an upper end press-fitted into an insertion hole opened in the flange of the bobbin, and a lower end formed with a forked portion press-fitted to an upper end of the terminal. The coil terminal is thereby firmly fixed to the terminal for sustaining the bobbin. Also, the structure makes it possible to firmly fix the coil terminal to the terminal by merely lowering the coil terminal toward the terminal, which enables automatic assembling of the coil terminal using a machine.

Further, the bobbin can be made to have flanges formed on opposite sides thereof so that one of the flanges has a projecting rod formed in a lower portion thereof for being fitted to a first fitting groove of the base, and the other one of the flanges has the coil terminal inserted therein. This makes it possible to securely fix the bobbin and improve vibration resistance and impact resistance for the electromagnetic relay.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. An electromagnetic relay structure, comprising:

a bobbin (1) having a coil (5) wound therearound and at least one projecting rod extending therefrom;

a coil terminal (6) electrically connected with an end (5*a*) of said coil (5);

a base (4) insert-formed with a terminal (8, 9) and a wall projection formed in a generally U-shape projecting from said base, said wall projection having a first fitting groove, a second fitting groove, and a third U-shaped cutout groove in an inner wall face thereof, said at least one projecting rod being press-fitted into said first fitting groove;

a yoke having a pair of tongue pieces press-fitted into said second fitting groove of said base, said yoke having a cutout groove;

a core extending through said bobbin and having a portion press-fitted to said cutout groove of said yoke, said core having a dished portion at one end thereof press-fitted into said third U-shaped cutout groove of said base;

a flange (1*c*) to which a first end of said coil terminal (6) is firmly attached, a second end of said coil terminal (6) being connected to said terminal (8, 9); and a projecting piece (6*a*) formed in a generally central portion of said coil terminal (6), said projecting piece (6*a*) being bent with an end (5*a*) of said coil (5) twined therearound.

2. The electromagnetic relay structure according to claim 1, wherein said coil terminal (6) has an upper end (6*c*) press-fitted into an insertion hole (1*d*) in said flange (1*c*) of said bobbin (1), and a lower end formed with a forked portion (6*b*) press-fitted to an upper end of said terminal (8, 9).

3. The electromagnetic relay structure according to claim 1, wherein said bobbin (1) has flanges (1*a*, 1*c*) formed on opposite ends thereof, a first one of said flanges (1*a*) having a projecting rod (1*b*) formed in a lower portion thereof for being fitted to a first fitting groove (4*a*) of said base (4), and a second one of said flanges (1*c*) having said coil terminal (6) inserted therein.

4. An electromagnetic relay structure, comprising:

a base having a first terminal extending therefrom and a wall projection formed in a generally U-shape projecting from said base, said wall projection having a first fitting groove, a second fitting groove, and a third U-shaped cutout groove in an inner wall face thereof;

a yoke having a pair of tongue pieces press-fitted into said second fitting groove of said base, said yoke having a cutout groove;

a bobbin having a coil wound therearound and first and second flanges at first and second ends of the bobbin, respectively, the coil having a first end for providing an electrical connection, and at least one projecting rod extending from said second flange of said bobbin, said at least one projecting rod being press-fitted into said first fitting groove of said base;

a core extending through said bobbin and having a portion press-fitted to said cutout groove of said yoke, said core having a dished portion at one end thereof press-fitted into said third U-shaped cutout groove of said base;

a second terminal having a first end firmly attached to said first flange and a second end connected to said first terminal; and a first projecting piece formed in a generally central portion of said second terminal, said first projecting piece being bent with said first end of said coil twined therearound.

5. The electromagnetic relay structure according to claim 4, wherein the first end of said second terminal is press-fitted into an insertion hole in said first flange, and the second end of said second terminal has a forked portion press-fitted to an end of said first terminal.

6. The electromagnetic relay structure according to claim 4, wherein said second terminal comprises a generally planar conductive member having a planar face which is generally parallel to a planar face of said first flange.

7. The electromagnetic relay structure according to claim 6, wherein said first projecting piece is integrally formed with said planar conductive member, said first projecting piece being bent approximately 180° back over the planar face of said planar conductive member with said first end of the coil twined around said first projecting piece.

8. The electromagnetic relay structure according to claim 4, further comprising:

said coil having a second end for providing an electrical connection;

a third terminal extending from said base;

a fourth terminal having a first end firmly attached to said first flange and a second end connected to said third terminal; and a second projecting piece formed in a generally central portion of said fourth terminal, said second projecting piece being bent with said second end of said coil twined therearound.

9. The electromagnetic relay structure according to claim 8, wherein the first end of said fourth terminal is press-fitted into a second insertion hole in said first flange, and the second end of said fourth terminal has a forked portion press-fitted to an end of said third terminal.

10. The electromagnetic relay structure according to claim 8, wherein said second and fourth terminals each comprises a generally planar conductive member having a planar face which is generally parallel to a planar face of said first flange.

11. The electromagnetic relay structure according to claim 10, wherein said first and second projecting pieces are integrally formed with the planar conductive members of said second and fourth terminals, respectively, said first and second projecting pieces each being bent approximately 180° back over the planar face of the second and fourth terminals, respectively, with said first and second ends of the coil twined around said first and second projecting pieces, respectively.

12. An electromagnetic relay structure, comprising:

a bobbin having a coil wound therearound and at least one projecting rod extending therefrom;

a coil terminal electrically connected with an end of said coil;

a base having a wall projection formed in a generally U-shape projecting from said base, said wall projection having stepwise a first fitting groove, a second fitting groove, and a third U-shaped cutout groove in an inner wall face of said wall projection, said at least one projecting rod being press-fitted into said first fitting groove;

a yoke having a pair of tongue pieces extending from one end that are press-fitted into said second fitting groove of said base, said yoke having a cutout groove formed between said pair of tongue pieces; and a core extending through said bobbin and having a portion press-fitted to said cutout groove of said yoke, said core having a dished portion at one end thereof press-fitted into said third U-shaped cutout groove of said base;

whereby said core and said bobbin are firmly fixed to said wall projection of the base with vibration resistance.

* * * * *